US008240493B2

(12) United States Patent
Lane

(10) Patent No.: US 8,240,493 B2
(45) Date of Patent: Aug. 14, 2012

(54) CONTAINER HAVING ORIENTED STANDING SURFACE

(75) Inventor: Michael T. Lane, Brooklyn, MI (US)

(73) Assignee: Amcor Limited, Abbotsford (AU)

( * ) Notice: Subject to any disclaimer, the term of this patent is extended or adjusted under 35 U.S.C. 154(b) by 489 days.

(21) Appl. No.: 12/493,345

(22) Filed: Jun. 29, 2009

(65) Prior Publication Data

US 2010/0326950 A1 Dec. 30, 2010

(51) Int. Cl.
*B65D 1/02* (2006.01)

(52) U.S. Cl. ..... 215/381; 215/370; 215/371; 215/373

(58) Field of Classification Search ..... 215/381, 215/370–373; D9/904, 905
See application file for complete search history.

(56) References Cited

U.S. PATENT DOCUMENTS

| | | | | | |
|---|---|---|---|---|---|
| D270,331 | S | * | 8/1983 | Benson | D9/520 |
| 5,054,631 | A | * | 10/1991 | Robbins, III | 215/389 |
| 5,092,474 | A | * | 3/1992 | Leigner | 215/381 |
| 5,222,615 | A | * | 6/1993 | Ota et al. | 215/375 |
| 5,284,272 | A | * | 2/1994 | Wei | 222/192 |
| 6,170,712 | B1 | * | 1/2001 | Kasboske | 222/215 |
| 6,223,932 | B1 | * | 5/2001 | Usui | 220/666 |
| D450,597 | S | * | 11/2001 | Bobchenok et al. | D9/571 |
| 6,857,531 | B2 | * | 2/2005 | Slat et al. | 215/382 |
| D532,697 | S | * | 11/2006 | Francis | D9/571 |
| D533,071 | S | * | 12/2006 | Forget | D9/564 |
| D540,683 | S | * | 4/2007 | Dow | D9/520 |
| D629,697 | S | * | 12/2010 | Laurent | D9/544 |
| 7,857,157 | B2 | * | 12/2010 | Lane et al. | 215/383 |
| 2004/0164045 | A1 | * | 8/2004 | Kelley | 215/373 |
| 2007/0045222 | A1 | * | 3/2007 | Denner et al. | 215/382 |

FOREIGN PATENT DOCUMENTS

| | | | |
|---|---|---|---|
| JP | 5-254530 | * | 10/1993 |
| JP | 2009-57082 | * | 3/2009 |

* cited by examiner

*Primary Examiner* — Tri Mai
(74) *Attorney, Agent, or Firm* — Harness, Dickey & Pierce, P.L.C.

(57) ABSTRACT

A plastic container having a shoulder region adapted for vacuum pressure absorption, a sidewall portion having a rigid support ledge and a tapered base structure having a geometrical shaped footprint. The base having an oriented standing surface to urge the container into a predetermined orientation during processing. The shoulder region including vacuum panels being movable to accommodate vacuum related forces generated within the container.

17 Claims, 4 Drawing Sheets

CONTAINER HAVING ORIENTED STANDING SURFACE

FIELD

The present disclosure relates to plastic containers for retaining a commodity and, more particularly, relates to a plastic container having an oriented standing surface that urges the plastic container into a predetermined position during processing in response to frictional forces acting upon the plastic container.

BACKGROUND

This section provides background information related to the present disclosure which is not necessarily prior art.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. Studies have indicated that the configuration and overall aesthetic appearance of a blow-molded plastic container can affect consumer purchasing decisions. For example, a dented, distorted or otherwise unaesthetically pleasing container may provide the reason for some consumers to purchase a different brand of product which is packaged in a more aesthetically pleasing fashion.

While a container in its as-designed configuration may provide an appealing appearance when it is initially removed from a blow-molding machine, many forces act subsequently on, and alter, the as-designed shape from the time it is blow-molded to the time it is placed on a store shelf in view of a consumer. Plastic containers are particularly susceptible to distortion since they are continually being re-designed in an effort to reduce the amount of plastic required to make the container. While this strategy realizes a savings with respect to material costs, the reduction in the amount of plastic can decrease container rigidity and structural integrity.

Manufacturers currently supply PET containers for various liquid commodities, such as juice and isotonic beverages. Suppliers often fill these liquid products into the containers while the liquid product is at an elevated temperature, typically between 155° F.-205° F. (68° C.-96° C.) and usually at approximately 185° F. (85° C.). When packaged in this manner, the hot temperature of the liquid commodity sterilizes the container at the time of filling. The bottling industry refers to this process as hot filling, and the containers designed to withstand the process as hot-fill or heat-set containers.

In many instances, container weight is correlated to the amount of the final vacuum present in the container after this fill, cap and cool down procedure, that is, the container is made relatively heavy to accommodate vacuum related forces. Similarly, reducing container weight, i.e., "lightweighting" the container, while providing a significant cost savings from a material standpoint, requires a reduction in the amount of the final vacuum.

External forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape.

More recently, container manufacturers have begun introducing multi-serve heat-set containers having a generally rectangular horizontal cross-sectional shape. Similar to the prior containers discussed above, these rectangular containers require a majority of the vacuum forces to be absorbed within the sidewall of the container. However, as these somewhat larger containers become increasingly lighter in weight, the weight of the fluid within the container reduces the amount of vacuum forces that the sidewall portion of the container can accommodate. Thus, this combination of lighter weight containers and increased weight of product within the container causes the sidewall portion of the container to sag and results in unwanted deformation in other areas of the container as well.

Moreover, as a result of the lighter weight containers, there has been an increased occurrence of deformation and/or damage of the containers during the filing and packaging process. That is, typically containers of this nature are processed along a series of stations, including for example a cooler station, combiner station, labeler station, case packing station, etc. The containers are transported along this series of stations via one or more conveyors upon which the container resides. The container typically engages the conveyor and is held in place simply by the frictional engagement of the bottom of the container (also known as the standing surface) and the conveyor belt. If any part of the series of stations needs to undergo reconfiguration, repair, and/or maintenance or is down for any reason, often times the remaining sections of the filling and packaging process continues, such that containers exiting one station are held before entering the next unavailable station. Therefore, a plurality of incoming containers on the conveyor will be pushed against other containers already in this staging area. The force of these incoming containers against existing containers (i.e. contact force) is dependent, at least in part, on the weight and rate of the incoming container along with the frictional contact of the incoming container with the conveyor.

Some attempts to minimize this contact force have included the use of lubricants disposed on the conveyor, near the staging area, to reduce the frictional connection between the incoming container and the conveyor. To this end, it is believed that the containers will more readily tolerate these contact forces and, therefore, be less likely to being damaged. However, due to the standing surface of most containers, these lubricants are often displaced and thus have short term benefits during system interruptions.

SUMMARY

This section provides a general summary of the disclosure, and is not a comprehensive disclosure of its full scope or all of its features.

According to the principles of the present teachings, a plastic container is provided having advantageous construction. The container comprising an upper portion having a mouth defining an opening into the container, a shoulder region extending from the upper portion, a sidewall portion extending from the shoulder region, and a base extending from the sidewall portion and closing off an end of the container. The base includes a plurality of raised strips disposed therein in contact with a conveyor that will aid in urging the container into a predetermined position in response to frictional forces acting on the container at the conveyor and raised strip interface. The upper portion, the shoulder region, the sidewall portion, and the base cooperate to define a receptacle chamber within the container into which product can be filled.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
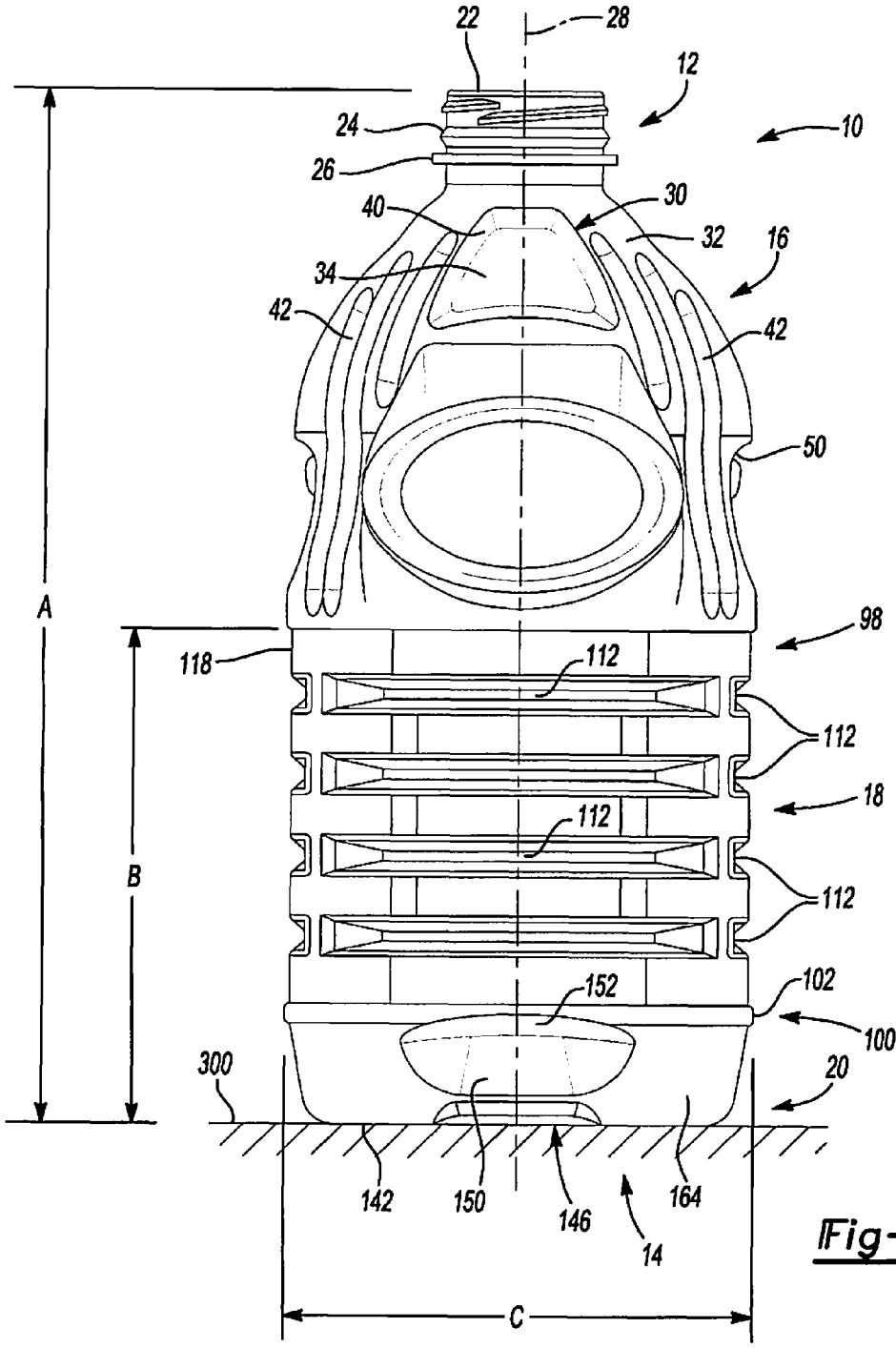
FIG. 1 is a front elevational view of a plastic container constructed in accordance with the teachings of a preferred embodiment of the present invention, the container as molded and empty, the rear view thereof being identical thereto.

Example embodiments will now be described more fully with reference to the accompanying drawings. Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As discussed above, to accommodate forces and procedures experienced during filling and packaging, it is desirable for manufacturers to provide means for minimizing the detrimental forces exerted upon containers during such filling and packaging operations, including those forces exerted upon the container due to hot-filling the container with liquid (i.e. heat-set) and/or those forces exerted upon the container due to the filling and conveyor methodology. Moreover, in some embodiments, it is desirable for manufacturers to provide means to urge containers into a predetermined orientation that is both conducive to filling and packaging. These features will be discussed in detail herein.

However, briefly, in some embodiments of the present teachings a container is provided having an advantageous construction that includes an oriented standing surface having a series of oriented raised strips that, among other things, can permit the container to orient in a predetermined positioned when passed along a conveyor line and can minimize or at least reduce the contact force between adjacent containers by reducing a frictional force between each of the containers and the conveyor in one direction. These features and benefits will be discussed in greater detail herein. However, in the meantime, it is believed that an overall discussion of the container of the present teachings is useful.

To accommodate vacuum related forces during cooling of the contents within a PET heat-set container, containers typically have a series of vacuum panels or pinch grips around their sidewall, and/or flexible grip areas. The vacuum panels, pinch grips and flexible grip areas all deform inwardly, to some extent, under the influence of vacuum related forces and prevent unwanted distortion elsewhere in the container. However, with vacuum panels and pinch grips, the container sidewall cannot be smooth or glass-like, an overlying label often becomes wrinkled and not smooth, and end users can feel the vacuum panels and pinch grips beneath the label when grasping and picking up the container. With flexible grip areas, the container may more easily slip from the consumer's hand and/or result in an overall insecure feel. Additionally, in somewhat larger lightweight containers, with the above features in place, the container sidewall does not possess the requisite structure to prevent sagging and general unwanted distortion.

Figure 2:
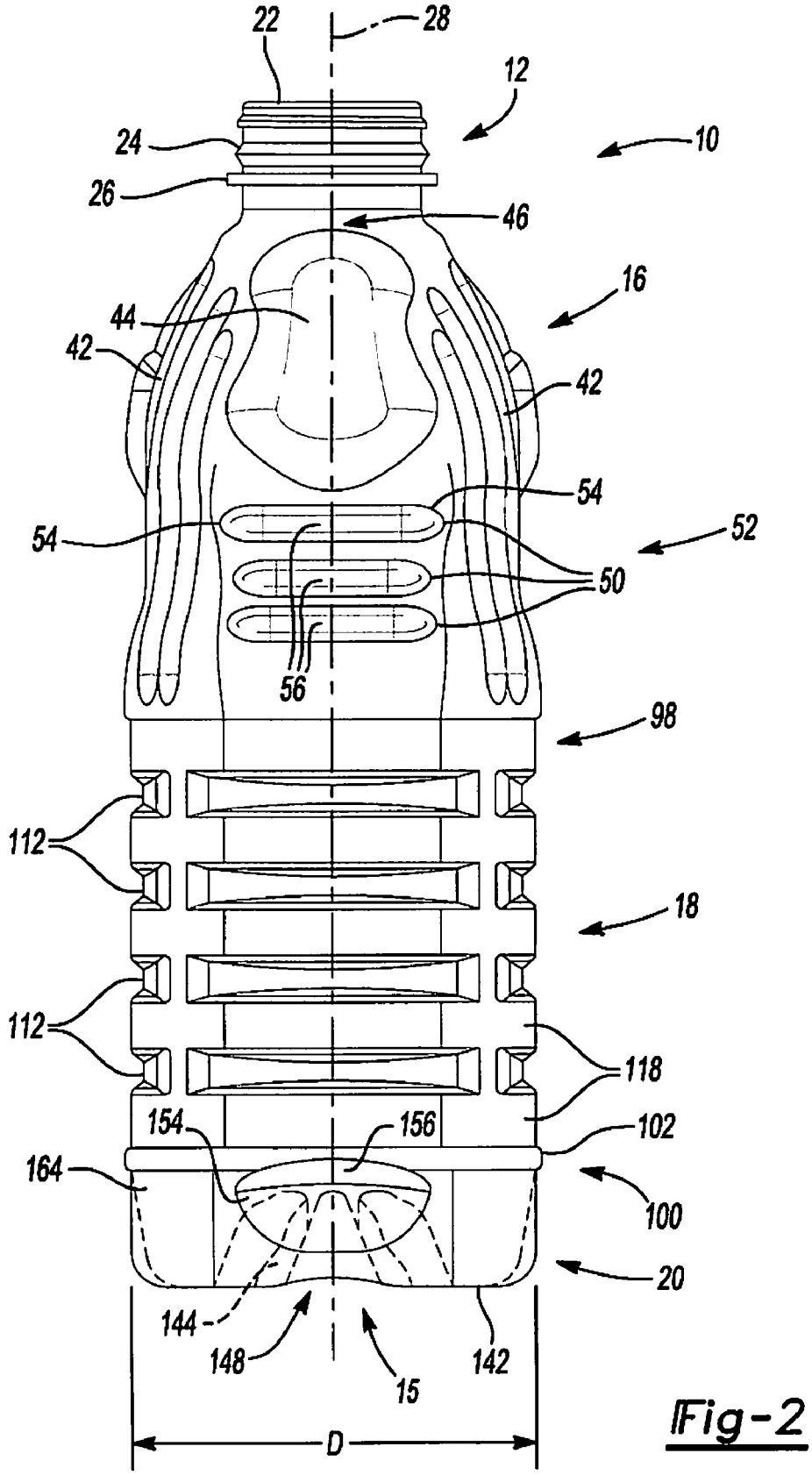
FIG. 2 is a right side view of the plastic container according to the present invention, the container as molded and empty, the left side view thereof being identical thereto.
Figure 3:
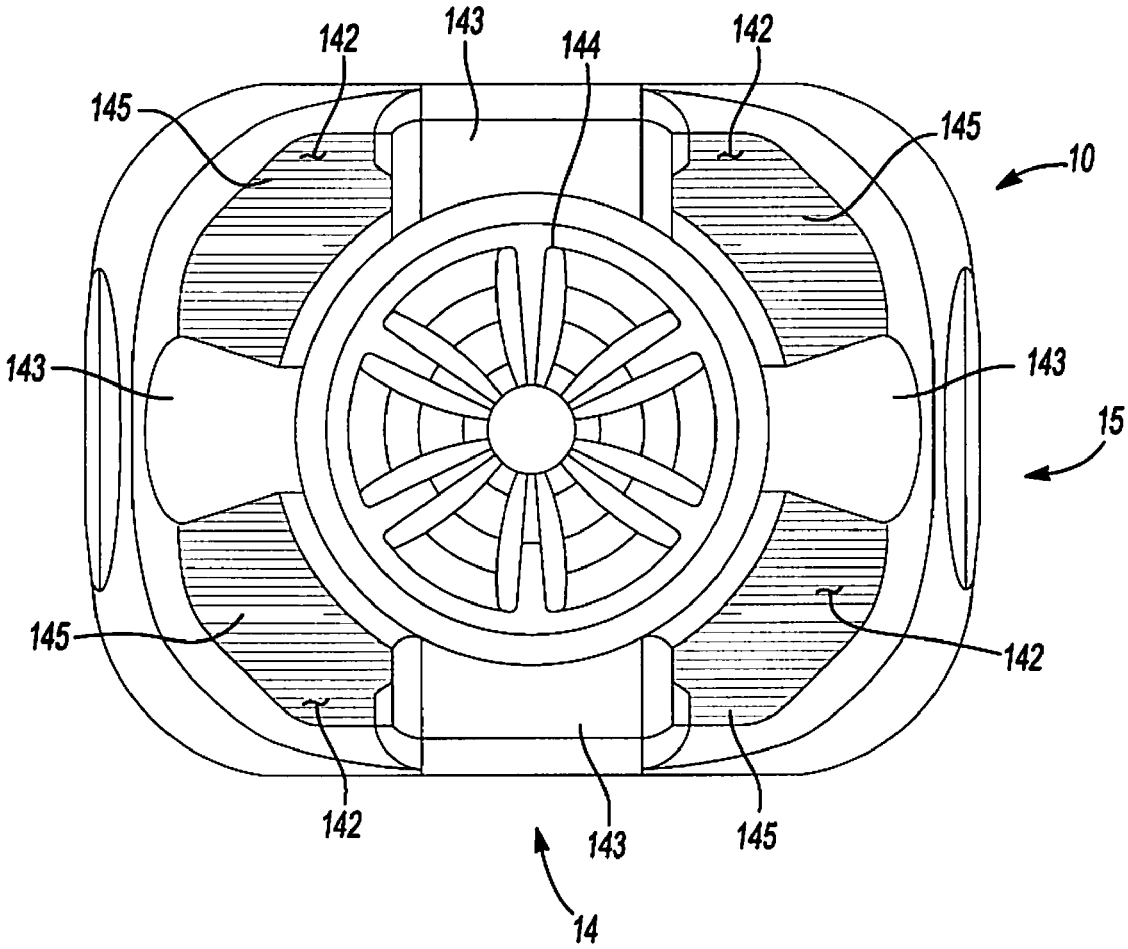
FIG. 3 is a bottom view of the plastic container of FIG. 1.

FIGS. 1-3 show one preferred embodiment of the present teachings. In the figures, reference number 10 designates a plastic, e.g. polyethylene terephthalate (PET), hot-fillable container. Although container 10 will be discussed in connection with specific dimensions and having specific attributes and features, it should be appreciated that some of the present attributes and features can be used in alternative container designs. Therefore, the present teachings should not be limited to the specific configuration illustrated and designed herein, unless otherwise stated.

As shown in FIG. 1, the container 10 has an overall height A of about 10.31 inch (261.78 mm), and a sidewall and base portion height B of about 4.95 inch (125.7 mm). The height A is selected so that the container 10 fits on the shelves of a supermarket or store. As shown in FIGS. 1-3, the container 10 is substantially rectangular in cross sectional shape including opposing longer sides 14 each having a width C of about 4.63 inch (117.7 mm), and opposing shorter, parting line sides 15 each having a width D of about 3.65 inch (92.76 mm). The widths C and/or D are selected so that the container 10 can fit within the door shelf of a refrigerator. Said differently, as with typical prior art bottles, opposing longer sides 14 of the container 10 of the present teachings are oriented at approximately 90 degree angles to the shorter, parting line sides 15 of the container 10 so as to form a generally rectangular cross section as shown in FIG. 3. In this particular embodiment, the container 10 has a volume capacity of about 1952.9 ml. Those of ordinary skill in the art would appreciate that the following teachings of the present disclosure are applicable to containers having other geometrical designs and arrangements, such as round, oval or square shaped containers, which may have different dimensions and volume capacities. It is also contemplated that other modifications can be made depending on the specific application and environmental requirements.

As shown in FIGS. 1-3, the plastic container 10 of the disclosure includes a finish 12, a shoulder region 16, a sidewall portion 18 and a base 20. Those skilled in the art know and understand that a neck (not illustrated) may also be included having an extremely short height, that is, becoming a short extension from the finish 12, or an elongated height, extending between the finish 12 and the shoulder region 16. The plastic container 10 has been designed to retain a commodity during a thermal process, typically a hot-fill process.

For hot-fill bottling applications, bottlers generally fill the container 10 with a liquid or product at an elevated temperature between approximately 155° F. to 205° F. (approximately 68° C. to 96° C.) and seal the container 10 with a closure (not illustrated) before cooling. As the sealed container 10 cools, a slight vacuum, or negative pressure, forms inside causing the container 10, in particular, the shoulder region 16 to change shape. In addition, the plastic container 10 may be suitable for other high-temperature pasteurization or retort filling processes, or other thermal processes as well.

The plastic container 10 of the present teachings is a blow molded, biaxially oriented container with a unitary construction from a single or multi-layer material. A well-known stretch-molding, heat-setting process for making the hot-fillable plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the container height. A machine (not illustrated) places the preform heated to a temperature between approximately 190° F. to 250° F. (approximately 88° C. to 121° C.) into a mold cavity (not illustrated) having a shape similar to the plastic container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 28 of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 12 and a sub-portion of the base 20 are not substantially molecularly oriented. The pressurized air holds the mostly biaxial molecularly oriented polyester material against the mold cavity for a period of approximately two (2) to five (5) seconds before removal of the container from the mold cavity. This process is known as heat setting and results in a heat-resistant container suitable for filling with a product at high temperatures. Those of ordinary skill in the art would appreciate that it is equally contemplated that other processes may be utilized to produce containers suitable for filling with product under ambient conditions or cold temperatures.

Alternatively, other manufacturing methods, such as for example, extrusion blow molding, one step injection stretch blow molding and injection blow molding, using other conventional materials including, for example, high density polyethylene, polypropylene, polyethylene naphthalate (PEN), a PET/PEN blend or copolymer, and various multilayer structures may be suitable for the manufacture of plastic container 10. Those having ordinary skill in the art will readily know and understand plastic container manufacturing method alternatives.

The finish 12 of the plastic container 10 includes a portion defining an aperture or mouth 22, a threaded region 24, and a support ring 26. The aperture 22 allows the plastic container 10 to receive a commodity while the threaded region 24 provides a means for attachment of a similarly threaded closure or cap (not illustrated). Alternatives may include other suitable devices that engage the finish 12 of the plastic container 10. Accordingly, the closure or cap (not illustrated) engages the finish 12 to preferably provide a hermetical seal of the plastic container 10. The closure or cap (not illustrated) is preferably of a plastic or metal material conventional to the closure industry and suitable for subsequent thermal processing, including high temperature pasteurization and retort. The support ring 26 may be used to carry or orient the preform (the precursor to the plastic container 10) (not illustrated) through and at various stages of manufacture. For example, the preform may be carried by the support ring 26, the support ring 26 may be used to aid in positioning the preform in the mold, or an end consumer may use the support ring 26 to carry the plastic container 10 once manufactured. However, as mentioned above, the container 10 can further include an oriented standing surface having a series of oriented raised strips that, among other things, can permit the container to orient in a predetermined position when passed along a conveyor line and can minimize or at least reduce the contact force between adjacent containers by reducing a frictional force between each of the containers and the conveyor in one direction. This feature will be discussed in greater detail below.

Integrally formed with the finish 12 and extending downward therefrom is the shoulder region 16. The shoulder region 16 merges into and provides a transition between the finish 12 and the sidewall portion 18. The sidewall portion 18 extends downward from the shoulder region 16 to the base 20. The specific construction of the shoulder region 16 of the container 10 allows the sidewall portion 18 of the container 10 to not necessarily require additional vacuum panels or pinch grips and therefore, the sidewall portion 18 is capable of providing increased rigidity and structural support to the container 10. The specific construction of the shoulder region 16 allows for manufacture of a significantly lightweight container. Such a container 10 can exhibit at least a 10% reduction in weight from those of current stock containers. The base 20 functions to close off the bottom portion of the plastic container 10 and, together with the finish 12, the shoulder region 16, and the sidewall portion 18, to retain the commodity.

In one example, the plastic container 10 is preferably heat-set according to the above-mentioned process or other conventional heat-set processes. To accommodate vacuum forces while allowing for the omission of vacuum panels and pinch grips in the sidewall portion 18 of the container 10, the shoulder region 16 of the present teachings includes vacuum panels 30 formed therein. As illustrated in the figures, vacuum panels 30 can be generally polygonal in shape or generally oval, and can be formed in the opposing longer sides 14 of the container 10. It should be appreciated that additional or fewer vacuum panels 30 can be used. The container 10 illustrated in the figures has two (2) vacuum panels 30. As such, it should be appreciated that vacuum panels 30 can also be formed in opposing shorter, parting line sides 15 of the container 10. Surrounding vacuum panels 30 is land 32. Land 32 provides structural support and rigidity to the shoulder region 16 of the container 10.

As illustrated in the figures, vacuum panels 30 of the container 10 include an underlying surface 34 and a perimeter wall or edge 40. The wall thickness of vacuum panels 30 must be thin enough to allow vacuum panels 30 to be flexible so as to function properly. With this in mind, those skilled in the art of container manufacture realize that the wall thickness of the container 10 varies considerably depending where a technician takes a measurement within the container 10.

Vacuum panels 30 also include, and are surrounded by, perimeter wall or edge 40. The perimeter wall or edge 40 defines a transition between the land 32 and the underlying surface 34 of vacuum panels 30. One should note that the perimeter wall or edge 40 is a distinctly identifiable structure between the land 32 and the underlying surface 34 of vacuum panels 30. The perimeter wall or edge 40 provides strength to the transition between the land 32 and the underlying surface 34. The resulting localized strength increases the resistance to creasing and denting in the shoulder region 16.

Upon filling, capping, sealing and cooling, the perimeter wall or edge 40 acts as a hinge that aids in the allowance of the underlying surface 34 of vacuum panels 30 to be pulled radially inward, toward the central longitudinal axis 28 of the container 10, displacing volume, as a result of vacuum forces. In this position, the underlying surface 34 of vacuum panels 30 forms a generally concave surface.

As illustrated in FIGS. 1 an 2, between opposing longer sides 14 and opposing shorter, parting line sides 15 of the container 10, in the corners of the shoulder region 16, are formed modulating vertical ribs 42. Modulating vertical ribs 42 can substantially follow the contour of the shoulder region 16 and can extend vertically continuously almost the entire distance of the shoulder region 16, between the finish 12 and the sidewall portion 18. Surrounding modulating vertical ribs 42 are land 32. As illustrated in the figures, modulating vertical ribs 42 are arranged between opposing longer sides 14 and opposing shorter, parting line sides 15 of the container 10, in the corners of the shoulder region 16, in arrangements of three (3). While the above-described geometry of modulating vertical ribs 42 is the preferred embodiment, a person of ordinary skill in the art will readily understand that other geometrical designs and arrangements are feasible. Accordingly, the exact shape, number and orientation of modulating vertical ribs 42 can vary greatly depending on various design criteria.

In order to provide enhanced vacuum force absorption and accommodate top load forces, additional geometry is also included in opposing shorter, parting line sides 15 of the shoulder region 16 of the container 10. As illustrated in the figures, support panels 44 are formed in an upper portion 46 of opposing shorter, parting line sides 15 of the shoulder region 16. Support panels 44 are generally surrounded by land 32. Support panels 44 are centrally formed in the upper portion 46 of opposing shorter, parting line sides 15 of the shoulder region 16, and are parallel to the central longitudinal axis 28. The land 32 and support panels 44 provide additional structural support and rigidity to the shoulder region 16 of the container 10.

As illustrated in the figures, opposing shorter, parting line sides 15 of the shoulder region 16 also include a plurality of ribs 50. Ribs 50 are centrally formed in a lower portion 52 of opposing shorter, parting line sides 15 of the shoulder region 16, below support panels 44. Ribs 50 are generally oval in shape having two half-circular end portions 54 separated by a horizontal portion 56. Ribs 50 are also surrounded by land 32. Similarly, the land 32 and ribs 50, in conjunction with support panels 44, provide additional structural support and rigidity to the shoulder region 16 of the container 10.

The unique construction of modulating vertical ribs 42, support panels 44 and ribs 50 add structure, support and strength to the shoulder region 16 of the container 10. This added structure and support, resulting from this unique construction, minimizes the outward movement or bowing, and denting of opposing shorter, parting line sides 15 of the shoulder region 16 of the container 10 during the fill, seal and cool down procedure. Thus, contrary to vacuum panels 30, modulating vertical ribs 42, support panels 44 and ribs 50 maintain their relative stiffness throughout the fill, seal and cool down procedure. The added structure and strength, resulting from the unique construction of modulating vertical ribs 42, support panels 44 and ribs 50, further aid in the transferring of top load forces thus aiding in preventing the shoulder region 16 of the container 10 from buckling, creasing, denting and deforming. Together, vacuum panels 30, modulating vertical ribs 42, support panels 44 and ribs 50 form a continuous integral rectangular shoulder region 16 of the container 10.

As illustrated in FIGS. 1-3, and briefly mentioned above, the sidewall portion 18 merges into and is unitarily connected to the shoulder region 16 and the base 20. Prior to this transition to the shoulder region 16 and the base 20, the sidewall portion 18 includes an upper ledge portion 98 and a lower ledge portion 100. The upper ledge portion 98 and the lower ledge portion 100 are mirror images of one another. The upper ledge portion 98 and the lower ledge portion 100 are defined, in part, by a peripheral ridge 102 formed in opposing longer sides 14 and opposing shorter, parting line sides 15 of the container 10.

The peripheral ridge 102 of the upper ledge portion 98 defines the transition between the shoulder region 16 and the sidewall portion 18, while the peripheral ridge 102 of the lower ledge portion 100 defines the transition between the base 20 and the sidewall portion 18. Accordingly, the peripheral ridge 102 of the upper ledge portion 98 and the peripheral ridge 102 of the lower ledge portion 100 are distinctly identifiable structures. The above-mentioned transitions must be abrupt in order to maximize the localized strength as well as form a geometrically rigid structure. The resulting localized strength increases the resistance to creasing, buckling, denting, bowing and sagging of the sidewall portion 18.

The unique construction of the upper ledge portion 98 of the sidewall portion 18 not only provides increased rigidity to the sidewall portion 18, but also provides additional support to a consumer when the consumer grasps the container 10 in this area of the sidewall portion 18. The upper ledge portion 98 has a height, width and depth that are dimensioned and structured to provide support for a variety of hand sizes. The upper ledge portion 98 is adapted to support the fingers and thumb of a person of average size. However, the support feature of the upper ledge portion 98 is not limited for use by a person having average size hands. By selecting and structuring the height, width and depth of the upper ledge portion 98, user comfort is enhanced, good support is achieved and this support feature is capable of being utilized by persons having a wide range of hand sizes. Moreover, the dimensioning and positioning of the upper ledge portion 98, and thus the support feature, facilitates holding, carrying and pouring of contents from the container 10. Alternatively, to facilitate consumer handling, an area just beneath the upper ledge portion 98 may include a depression or indent.

The sidewall portion 18 further includes a series of horizontal ribs 112 formed in opposing longer sides 14 and opposing shorter, parting line sides 15 of the container 10. Horizontal ribs 112 are interrupted at the corners but are generally aligned to essentially circumscribe the entire perimeter of the sidewall portion 18 of the container 10. Horizontal ribs 112 extend in a longitudinal direction from the shoulder region 16 to the base 20. Defined between each adjacent horizontal rib 112 are lands 118. Lands 118 provide additional structural support and rigidity to the sidewall portion 18 of the container 10.

As is commonly known and understood by container manufacturers skilled in the art, a label may be applied to the sidewall portion 18 using methods that are well known to those skilled in the art, including shrink wrap labeling and adhesive methods. As applied, the label may extend around the entire body or be limited to a single side of the sidewall portion 18.

The unique construction of the sidewall portion 18 provides added structure, support and strength to the sidewall portion 18 of the container 10. This added structure, support and strength enhances the top load strength capabilities of the container 10 by aiding in transferring top load forces, thereby preventing creasing, buckling, denting and deforming of the container 10 when subjected to top load forces. Furthermore, this added structure, support and strength, resulting from the unique construction of the sidewall portion 18, minimizes the outward movement, bowing and sagging of the sidewall portion 18 during fill, seal and cool down procedure. Thus, contrary to vacuum panels 30 formed in the shoulder region 16, the sidewall portion 18 maintains its relative stiffness throughout the fill, seal and cool down procedure. Accordingly, the distance from the central longitudinal axis 28 of the container 10 to the sidewall portion 18 is fairly consistent throughout the entire longitudinal length of the sidewall portion 18 from the shoulder region 16 to the base 20, and this distance is generally maintained throughout the fill, seal and cool down procedure. Additionally, the lower ledge portion 100 of the sidewall portion 18 isolates the base 20 from any possible sidewall portion 18 movement and creates structure, thus aiding the base 20 in maintaining its shape after the container 10 is filled, sealed and cooled, increasing stability of the container 10, and minimizing rocking as the container 10 shrinks after initial removal from its mold.

The base 20 of the container 10 is tapered, extending inward from the sidewall portion 18. To this end, opposing longer sides 14 of the base 20 have an angle of divergence from a vertical plane that is less than the angle of divergence from a vertical plane for the opposing shorter, parting line sides 15 of the base 20. Accordingly, opposing shorter, parting line sides 15 of the base 20 will generally have a greater degree of taper than opposing longer sides 14 of the base 20. This improves ease of manufacture and results in more consistent material distribution in the base. Thus, improving container stability and eliminating the need for a traditional non-round base push-up, which must be oriented in the mold.

As illustrated in FIG. 3, the base 20 is generally octagonal in shape, creating a generally octagonal footprint. The base 20 generally includes a contact surface 142 and a circular push up 144. The contact surface 142 is itself that portion of the base 20 that contacts a support surface that in turn supports the container 10. The circular push up 144 is generally centrally located in the base 20. Because the circular push up 144 is centrally located in the base 20, there is no need to further orient the container 10 in the mold, thus promoting ease of manufacture.

Still referring to FIG. 3, the contact surface 142 is generally a flat surface or line of contact generally circumscribing, continuously or intermittently, the base 20 to provide a support surface engagable with an underlining surface 300 (i.e. conveyor, pallet, store shelf, and the like). In the preferred embodiment, as illustrated in FIG. 3, the contact surface 142 is a uniform, generally octagonal shaped surface that provides a greater area of contact with the support surface, thus promoting greater container stability. This octagonal shaped surface has portions removed and spaced apart from the underlining surface, such as that associated with circular push up 144 and various contact surface reliefs 143. Contact surface reliefs 143 are formed generally along a horizontal plane parallel to and offset from the underlining surface. Contact surface reliefs 143 provide the ability to reduce the overall contact surface contacting the underlining surface and further provide the ability to ensure that container 10 is supported upon underlining surface at only known locations.

The contact surface 142 can comprise a series of oriented raised strips 145 that are formed on contact surface 142. Raised strips 145 define a pattern of closely spaced strips each including a raised portion that contacts the underlining surface upon which container 10 sits, thereby bearing the weight of the container 10 thereon and defining a contact surface area between container 10 and the underlining surface. It should be appreciated that the measure of contact surface area of contact surface 142, that is the surface area in physical contact with the underlining surface, will be dependent upon the overall area upon which the raised strips 145 are disposed and the associated size and number of raised strips 145 disposed on contact surface 142. However, the contact surface area of contact surface 142 having raised strips 145 will be less than a similarly sized contact surface having a planar construction (i.e. absent raised strips).

In some embodiments, raised strips 145 can be formed as a plurality of parallel strips each being narrowly spaced and defining a depth therebetween. Specifically, by way of non-limiting example, raised strips 145 can each measure 0.020 inch (0.5 mm) deep, 0.039 inch (1 mm) wide, and spaced 0.039 inch (1 mm) apart. However, it should be understood that alternative size strips and/or strips having subtle interruptions, variations, being non-continuous can be employed.

Still referring to FIG. 3, in some embodiments raised strips 145 can be formed in each of four quadrants or contact surface regions separated by circular push up 144 and contact surface reliefs 143. Raised strips 145 are illustrated as being parallel in each of the four quadrants relative to other quadrants, but it should be appreciated that the size and orientation of raised strips 145 can vary from one quadrant or section to another. The specific size and orientation of raised strips 145 can have an effect on the frictional forces exerted on container 10, therefore their design and orientation can be tailored to fit the specific needs and characteristics of the particular application, and filling and manufacturing methodology.

Figure 4:
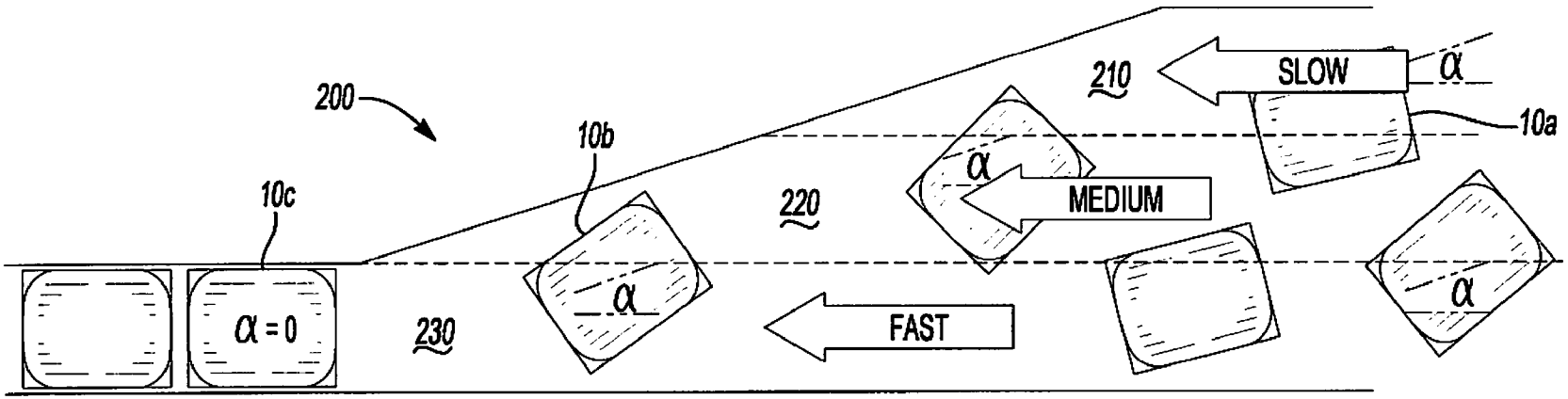
FIG. 4 is a schematic view of a conventional combiner system for transporting the plastic container according to the present teachings.

In some embodiments, as illustrated in FIG. 4, container 10 can be filled and processed whereby a combiner system is used to feed containers onto a feed conveyor. The combiner 200 can include a series of conveyors each having a relative conveyor speed of slow (indicated at reference 210), medium (indicated at reference 220), and fast (indicated at reference 230). When a container 10, having raised strips 145, is disposed in combiner 200, the orientation of raised strips 145 on contact surface 142 of container 10 can serve to rotate container 10 into the proper position for downstream processing. Specifically, as illustrated in FIG. 4, when raised strips 145 are oriented relative to the direction of travel of conveyors 210, 220, 230 a relative angle $\alpha$ is formed. As the angle $\alpha$ increases (whereby raised strips 145 become more perpendicular to the direction of travel of conveyors 210, 220, 230) the contact surface area between conveyors 210, 220, 230 in the direction of applied force is increased. That is, in other words, the raised strips 145 are turned and a greater length thereof is exposed to the applied force from conveyors 210, 220, 230 resulting in a greater force applied to container 10. Likewise, as the angle $\alpha$ decreases (whereby raised strips 145 become more parallel to the direction of travel of conveyors 210, 220, 230) the contact surface area between conveyors 210, 220, 230 in the direction of applied force is decreased. That is, in other words, the raised strips 145 are turned and a lesser length thereof is exposed to the applied force from conveyors 210, 220, 230 resulting in a lesser force applied to container 10. Therefore, in the present embodiment, the force applied to container 10 is maximized when applied from longer side 14 (force acting on the length of raised strips 145) and minimized when applied from the parting line side 15 (force acting merely on the ends of raised strips 145). Generally, raised strips 145 are operable to define a greater coefficient of friction between the container 10 and the conveyor in a direction transverse to the raised strips 145 and a lesser coefficient of friction between the container 10 and the conveyor in a direction parallel to the raised strips 145.

This phenomenon can be used for orienting container 10 on conveyors 210, 220, 230 and container 10 will be urged into a position wherein raised strips 145 are aligned with the direction of travel of conveyors 210, 220, 230 by virtue of container 10 naturally seeking a position where the applied force is minimized and balanced. To this end, as seen in FIG. 4, container 10*a* will be urged from slow conveyor 210 to medium conveyor 220 by virtue of raised strips 145 seeking a position aligned with conveyor 220. Furthermore, the greater relative speed of conveyor 220 to conveyor 210 will pull container 10*a* onto conveyor 220. Likewise, container 10*b* will be urged from conveyor 220 to conveyor 230 and aligned such that angle $\alpha$ is minimized and container 10*b* seeks a position whereby raised strips 145 are aligned with conveyor 230.

Once container 10 (i.e. 10*c* in FIG. 4) is positioned on conveyor 230 such that raised strips 145 are aligned with conveyor 230 and angle $\alpha$ is generally minimized, the frictional force between container 10*c* and conveyor 230 is reduced by virtue of the aligned orientation of raised strips 145 (i.e. force acting merely on the ends of raised strips 145). This provides a benefit in that when a processing backup occurs and containers 10 begin impacting each other upstream of the stoppage, the force of a moving container impact another container is reduced thereby reducing the chance of impact damage on the containers. This reduction of impact force is due to the reduced contact surface area between the moving container and the conveyor and also the reduced contact surface area between the stationary container and the conveyor.

Conventionally, such impact force between containers was reduced during processing backups by applying a lubricant to the conveyor line. This lubricant would artificially reduce the friction coefficient between the container and the conveyor thereby reducing impact forces and container back pressures. However, with conventional containers having flat contact surfaces, the lubricant would quickly be displaced by the containers. However, according to the principles of the present teachings, it has been found that container 10, when using the raised strips 145, not only may reduce the need for such lubricants during processing backups, but also, when such lubricants are used, reduces lubricant displacement because of the alignment of raised strips 145 with the direction of conveyor travel.

As a result of the use of raised strips 145, it has been found that impact forces and container back pressures are significantly reduced, thereby minimizing container dents and damage. As such, it has been found that thinner containers can be used, which reduces materials and transportation costs.

The base 20 further includes support panels 146 formed in opposing longer sides 14 of the base 20 and support panels 148 formed in opposing shorter, parting line sides 15 of the base 20. Support panels 146 include a vertical surface 150 and a downwardly angled surface 152. Support panels 148 include a vertical surface 154 and a downwardly angled surface 156. Support panels 146 and 148 are surrounded by land 164.

The foregoing description of the embodiments has been provided for purposes of illustration and description. It is not intended to be exhaustive or to limit the invention. Individual elements or features of a particular embodiment are generally not limited to that particular embodiment but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A plastic container that is supportable upright on a support surface comprising:

an upper portion having a mouth defining an opening into said container;

a shoulder region extending from said upper portion;

a sidewall portion extending from said shoulder region, said sidewall portion having a generally rectangular horizontal cross section and including two opposing longer sidewalls and two opposing shorter sidewalls;

a base extending from said sidewall portion and closing off an end of said container, said base having a contact surface that is operable to contact the support surface to support the container upright on the support surface, the contact surface including only a plurality of raised strips that longitudinally extend substantially parallel to the two opposing longer sidewalls such that each of the plurality of raised strips included on the contact surface longitudinally extend substantially parallel to the two opposing longer sidewalls; and said upper portion, said shoulder region, said sidewall portion and said base cooperating to define a receptacle chamber within the container into which product can be filled.

2. The plastic container according to claim 1, further comprising:

a vacuum panel formed in said shoulder region, said vacuum panel being movable to accommodate vacuum forces generated within the container resulting from heating and cooling of its contents.

3. The plastic container according to claim 1 wherein the support surface is a conveyor and wherein said plurality of raised strips are generally parallel to each other and oriented to urge the container into a predetermined position on the conveyor, wherein the plurality of raised strips longitudinally extend substantially parallel to a direction of travel of the conveyor when in the predetermined position.

4. The plastic container according to claim 1 wherein said base comprises at least one of a recessed relief and a push up, the at least one of the recessed relief and the push up being recessed away from the contact surface to be spaced away from the contact surface, the at least one of the recessed relief and the push up separating the contact surface into a plurality of contact surface regions each having said plurality of raised strips.

5. The plastic container according to claim 1 wherein said two opposing longer sidewalls and said two opposing shorter sidewalls extend into said shoulder region.

6. The plastic container according to claim 5 wherein said shoulder region includes two generally polygonal shaped vacuum panels, one formed in each of said opposing longer sidewalls of said shoulder region, and two support panels, one formed in each of said opposing shorter sidewalls of said shoulder region.

7. The plastic container according to claim 6 wherein said shoulder region further includes a plurality of modulating vertical ribs formed therein, said plurality of modulating vertical ribs located between said generally polygonal shaped vacuum panels and said support panels.

8. The plastic container of claim 1, wherein the contact surface is divided into quadrants on the base.

9. A plastic container that is supportable upright on a conveyor, said conveyor defining a direction of travel, said plastic container comprising:

an upper portion having a mouth defining an opening into said container;

a shoulder region extending from said upper portion;

a sidewall portion extending from said shoulder region, said sidewall portion having a generally rectangular horizontal cross section and including two opposing longer sidewalls and two opposing shorter sidewalls;

a base extending from said sidewall portion and closing off an end of said container, said base having a contact surface that is operable to contact-the conveyor, said contact surface having only a plurality of raised strips that longitudinally extend substantially parallel to the two opposing longer sidewalls such that each of the plurality of raised strips included on the contact surface longitudinally extend substantially parallel to the two opposing longer sidewalls, the plurality of raised strips operable to engage with the conveyor, said plurality of raised strips operable to define a greater coefficient of friction between the container and the conveyor when the plurality of raised strips are oriented in a direction transverse to the direction of travel and a lesser coefficient of friction between the container and the conveyor when the raised strips are oriented in a direction parallel to the direction of travel; and said upper portion, said shoulder region, said sidewall portion and said base cooperating to define a receptacle chamber within the container into which product can be filled.

10. The plastic container according to claim 9, further comprising:

a vacuum panel formed in said shoulder region, said vacuum panel being movable to accommodate vacuum forces generated within the container resulting from heating and cooling of its contents.

11. The plastic container according to claim 9 wherein said base comprises at least one of a recessed relief and a push up, the at least one of the recessed relief and the push up being recessed away from the contact surface to be spaced away from the conveyor, the at least one of the recessed relief and the push up separating the contact surface into a plurality of contact surface regions each having said plurality of raised strips.

12. The plastic container according to claim 9 wherein said two opposing longer sidewalls and said two opposing shorter sidewalls extend into said shoulder region.

13. The plastic container according to claim 12 wherein said shoulder region includes two generally polygonal shaped vacuum panels, one formed in each of said opposing longer sidewalls of said shoulder region, and two support panels, one formed in each of said opposing shorter sidewalls of said shoulder region.

14. The plastic container according to claim 13 wherein said shoulder region further includes a plurality of modulating vertical ribs formed therein, said plurality of modulating vertical ribs located between said generally polygonal shaped vacuum panels and said support panels.

15. The plastic container of claim 9, wherein the contact surface is divided into quadrants on the base.

16. The plastic container of claim 9, wherein said base comprises a plurality of recessed reliefs and a push up, the plurality of recessed reliefs and the push up being recessed away from the contact surface to be spaced away from the conveyor, the plurality of recessed reliefs separating the contact surface into a plurality of contact surface regions that each include the plurality of raised strips, the plurality of recessed reliefs and the plurality of contact surface regions collectively surrounding the push up.

17. The plastic container of claim 1, wherein said base comprises a plurality of recessed reliefs and a push up, the plurality of recessed reliefs and the push up being recessed away from the contact surface to be spaced away from the support surface, the plurality of recessed reliefs separating the contact surface into a plurality of contact surface regions that each include the plurality of raised strips, the plurality of recessed reliefs and the plurality of contact surface regions collectively surrounding the push up.

* * * * *